US006821093B2

(12) United States Patent
Zagranski et al.

(10) Patent No.: US 6,821,093 B2
(45) Date of Patent: Nov. 23, 2004

(54) FLOW METER

(75) Inventors: Raymond D. Zagranski, Somers, CT (US); Roger Lapointe, Feeding Hills, MA (US); William H. Dalton, Amston, CT (US); Frank M. Amazeen, West Hartford, CT (US)

(73) Assignee: Goodrich Pump & Engine Control Systems, Inc., Charlotte, NC (US)

( * ) Notice: Subject to any disclaimer, the term of this patent is extended or adjusted under 35 U.S.C. 154(b) by 0 days.

(21) Appl. No.: 10/338,332

(22) Filed: Jan. 8, 2003

(65) Prior Publication Data

US 2003/0098072 A1 May 29, 2003

Related U.S. Application Data

(60) Division of application No. 09/867,359, filed on May 29, 2001, now Pat. No. 6,623,250, which is a continuation-in-part of application No. 09/506,465, filed on Feb. 17, 2000, now abandoned.

(51) Int. Cl.[7] ..... F04B 49/00
(52) U.S. Cl. ..... 417/220; 418/30
(58) Field of Search ..... 417/63, 220; 418/2, 418/30

(56) References Cited

U.S. PATENT DOCUMENTS

| | | | | |
|---|---|---|---|---|
| 2,322,568 A | * | 6/1943 | De Lancey | 417/220 |
| 2,490,115 A | * | 12/1949 | Clarke | 417/220 |
| 2,600,632 A | * | 6/1952 | French | 417/220 |
| 2,606,503 A | | 8/1952 | Shaw | |
| 2,907,279 A | * | 10/1959 | Carleton | 417/220 |
| 2,975,717 A | * | 3/1961 | Rynders et al. | 417/220 |
| 3,153,984 A | | 10/1964 | Fikse | |
| 3,695,789 A | | 10/1972 | Jansson | |
| 3,723,025 A | | 3/1973 | Coakley | |
| 3,752,189 A | | 8/1973 | Marr et al. | |
| 3,792,936 A | | 2/1974 | Pettibone et al. | |
| 3,812,765 A | | 5/1974 | Himmler | |
| 3,958,494 A | | 5/1976 | Miller | |
| 4,198,195 A | | 4/1980 | Sakamaki et al. | |
| 4,338,965 A | | 7/1982 | Garnjost et al. | |
| 4,342,545 A | | 8/1982 | Schuster | |
| 4,348,159 A | | 9/1982 | Acheson | |
| 4,443,159 A | * | 4/1984 | Dantlgraber | 417/220 |
| 4,496,290 A | * | 1/1985 | Nonnenmacher | 417/220 |
| 4,531,898 A | * | 7/1985 | Ideta | 418/30 |
| 4,540,347 A | | 9/1985 | Child | |

(List continued on next page.)

FOREIGN PATENT DOCUMENTS

| | | |
|---|---|---|
| EP | 1 048 842 A2 | 2/2000 |
| FR | 2 764 336 | 12/1998 |

OTHER PUBLICATIONS

Communication: European Search Report for Ser. No. 02010074.9, Aug. 22, 2003.

*Primary Examiner*—John Rivell
(74) *Attorney, Agent, or Firm*—Edwards & Angell, LLP; George N. Chaclas

(57) ABSTRACT

A fuel metering unit including a pump having a rotor with a plurality of slots. The pump also includes a pivotally movable cam ring coaxially arranged with respect to the rotor. Vanes are slideably disposed in the slots for maintaining contact with the cam ring during movement thereof. A servovalve has a motor and nozzles operatively connected to the pump such that increased flow through the first nozzle pivots the ring of the pump toward maximum while increased flow through the second nozzle pivots the ring toward minimum. An arm extends between the nozzles for varying fluid flow therethrough. The arm couples to the motor such that the motor moves the arm. A flow meter connects to the pump and an end of the arm for applying a force against the arm to assist in maintaining position of the arm.

8 Claims, 6 Drawing Sheets

U.S. PATENT DOCUMENTS 4,558,998 A * 12/1985 Kiyoshige et al. ..... 418/30
4,567,813 A 2/1986 Garnjost
4,768,540 A 9/1988 Mochizuki et al.
4,770,612 A 9/1988 Teubler
4,971,535 A 11/1990 Okada et al.
5,035,254 A 7/1991 Blatter et al.
5,141,418 A 8/1992 Ohtaki et al.
5,168,704 A 12/1992 Kast et al.
5,174,339 A 12/1992 Pickard
5,178,525 A 1/1993 Murota
5,209,058 A 5/1993 Sparks et al.
5,235,806 A 8/1993 Pickard
5,266,018 A 11/1993 Niemiec
5,413,466 A 5/1995 Bennett et al.
5,448,882 A 9/1995 Dyer et al.
5,484,271 A 1/1996 Stich
5,505,592 A 4/1996 Kumagai et al.
5,518,380 A 5/1996 Fujii et al.
5,538,400 A 7/1996 Konishi et al.
5,545,018 A 8/1996 Sundberg
5,562,432 A 10/1996 Semba et al.
5,690,479 A * 11/1997 Lehmann et al. ..... 418/30
5,715,674 A 2/1998 Reuter et al.
5,716,201 A 2/1998 Peck et al.
5,733,109 A 3/1998 Sundberg
5,738,500 A 4/1998 Sundberg et al.
5,800,131 A 9/1998 Lehmann et al.
5,806,300 A 9/1998 Veilleux, Jr. et al.
5,833,438 A 11/1998 Sundberg
5,895,209 A * 4/1999 Miyazawa ..... 418/30
5,896,737 A 4/1999 Dyer
6,102,001 A 8/2000 McLevige
6,578,777 B2 6/2003 Bui

* cited by examiner

FLOW METER

CROSS-REFERENCE TO RELATED APPLICATION

The present application is a divisional application of U.S. patent application Ser. No. 09/867,359, filed on May 29, 2001 now U.S. Pat. No. 6,623,250, which is a continuation-in-part of U.S. patent application Ser. No. 09/506,465 filed Feb. 17, 2000 now abandoned, the disclosure of which is herein incorporated by reference in its entirety.

BACKGROUND OF THE DISCLOSURE

1. Field of the Disclosure

The present disclosure generally relates to a fuel metering unit for a combustion engine, and more particularly, to a fuel metering unit including a variable displacement vane pump with an electronic controller for modulating the output flow thereof.

2. Description of the Related Art

Variable displacement vane pumps are known in the art, as disclosed for example in U.S. Pat. No. 5,833,438 to Sundberg. A fuel metering unit of a combustion engine that utilizes a variable displacement vane pump for precisely metering pressurized fuel to a manifold of the engine also includes associated valves and electromechanical feed back devices integrated with an electronic engine controller. The vane pump includes a rotor that turns upon operation of the metering unit, and a pivotally mounted cam ring co-axially arranged with respect to the rotor. Sliding vane elements radially extend from the rotor such that outer tips of the vane elements contact a radially inward surface of the cam ring. A cavity formed between the cam ring and the rotor includes a high pressure zone connected to an outlet of the vane pump, and a low pressure zone connected to an inlet of the vane pump. As the rotor is turned, the vane elements pump fuel from the low pressure zone to the high pressure zone. Pivoting the cam ring varies the relative positions of the rotor and the cam ring such that the amount of fuel pumped by the vane elements also varies. Controlling the position of the cam ring with respect to the rotor, therefore, controls the output of the vane pump.

One method of controlling the position of the cam ring is by using a torque motor operated servovalve. The servovalve scavenges some of the pressurized fuel exiting the vane pump and divides and directs the scavenged fuel so that a first portion of the scavenged flow is used to pivot the cam ring in a first direction, and a second portion is used to pivot the cam ring in a second direction. Altering the amounts of the first and second portions of the scavenged fuel, therefore, causes the cam ring to pivot.

The amounts of the first and second portions of the scavenged fuel produced by the servovalve is controlled by the torque motor, which is responsive to electrical signals received from an electronic controller of the turbine engine with which the fuel-metering unit is associated. U.S. Pat. No. 5,716,201 to Peck et al., for example, discloses a fuel metering unit including a vane pump, a torque motor operated servovalve and electromechanical feedback for varying the displacement of the vane pump.

It would be desirable to provide a fuel metering unit including means to provide feedback to the torque motor operated servovalve, so that the actual output of the vane pump matches a preferred output of the vane pump, as requested by the electronic engine controller. In addition, it would be desirable to provide means for damping changes in the output of the vane pump to prevent the cam ring from swinging in an uncontrolled manner.

As described in the prior art, a variable displacement vane pump also includes endplates for sealing the cavity between the rotor and the cam ring. Preferably, the endplates are tightly clamped against ends of the cam ring to prevent fuel leakage. Such tight clamping, however, makes pivotal movement of the cam ring more difficult due to the friction between the cam ring and the endplates. One solution to reducing or eliminating friction between the cam ring and the endplates while controlling fuel leakage has been to place an axial spacer radially outside of the cam ring. The axial spacer has a thickness that is slightly greater than a thickness of the cam ring, so that the endplates can be tightly clamped against the axial spacer while allowing small gaps to remain between the cam ring and the endplates to reduce or eliminate friction between the cam ring and the endplates. U.S. Pat. No. 5,738,500 to Sundberg et al., for example, discloses a variable displacement vane pump including an axial spacer.

A disadvantage of such an axial spacer, however, is that the small gaps provided between the cam ring and the endplates allow fuel leakage between the low pressure and high pressure zones formed between the cam ring and the rotor, thereby reducing pump efficiency. Therefore, it would be beneficial to provide a variable displacement vane pump that allows the cam ring to pivot without friction, while reducing fuel leakage between the low pressure and high pressure zones of the vane pump.

It is further desirable to monitor fuel flow to the engine manifold. Traditional fuel flow sensors have required electrical interfaces. Such electrical interfaces significantly increase the cost and complexity of a fuel metering system. A further undesirable characteristic of prior art fuel flow sensors is the appreciable hysteresis effect that results from side-wall friction. Thus, there is a need for a fuel flow sensor which provides control without an electrical interface. There is a further need for a fuel flow sensor without appreciable hysteresis and an accurate electromechanical sensor.

SUMMARY OF THE DISCLOSURE

The present disclosure, accordingly, provides a fuel metering unit for a combustion engine including a servovalve having a torque motor for applying a force, a first nozzle in fluid communication with the fuel pump and a second nozzle in fluid communication with the fuel pump. An arm extends between the first and the second nozzles for varying fluid flow through the first and the second nozzles upon lateral movement of the arm. The arm is secured at a proximal end to the torque motor, whereby the arm moves upon actuation of the torque motor. A flow meter in fluid communication with an output of the fuel pump and operatively connected to a distal end of the arm variably applies a biasing force against the distal end of the arm in response to the output of the fuel pump. In another embodiment, the fuel metering unit also includes a sensor operatively associated with the flow meter for indicating a fuel flow rate output from the fuel pump.

Also disclosed is a system for indicating an output of a fuel pump including an arm for controlling the output of the fuel pump. A motor couples to a first end of the arm for positioning the arm. A housing defines an internal chamber, a primary inlet for receiving the output of the fuel pump, an outlet in fluid communication with the primary inlet, and a secondary inlet for receiving a scavenged portion of the output passing through the outlet. A valve member is slidingly received within the internal chamber such that the output and the scavenged portion exerts a force on the valve member, wherein the valve member is coupled to a second end of the arm for transmitting the force to the arm in order to assist the motor in positioning the arm. In one embodiment, the valve member is coupled to the arm by a spring.

In another embodiment, a fuel metering unit includes a variable displacement pump having a rotor including a plurality of radially extending vane slots and a cam ring coaxially arranged with respect to the rotor. The cam ring is pivotally movable between a maximum stop and a minimum stop with respect to the rotor. Vanes are slideably disposed in the radially extending vane slots for maintaining contact with the cam ring during movement thereof. A servovalve has a torque motor including an armature having opposite ends that move in opposed lateral directions in response to the torque motor receiving an electrical current from an electronic engine controller. First and second nozzles are operatively connected to an output of the variable displacement pump such that increased fluid flow through the first nozzle pivots the cam ring of the vane pump toward maximum stop while increased fluid flow through the second nozzle pivots the cam ring toward minimum stop. An elongated arm extends between the first and the second nozzles for varying fluid flow through the first and the second nozzles by movement of the elongated arm. The elongated arm is secured at a first end to the armature of the torque motor such that the elongated arm moves in response to the torque motor receiving an electrical current from the electronic engine controller. A flow meter is connected to a high pressure outlet of the vane pump and operatively connected to a second end of the elongated arm for variably applying a force against the elongated arm in response to the output of the vane pump for assisting in maintaining positioning of the elongated arm and, thereby, the cam ring.

The present disclosure also provides a vane pump including a rotor, a cam ring arranged coaxial and pivotally movable with respect to the rotor, and an axial spacer arranged coaxial with respect to the cam ring. The vane pump includes circumferential seals to reduce fuel leakage between the low pressure and high pressure zones of the vane pump in order to improve pump efficiency.

Further features of the fuel metering unit and the variable displacement vane pump according to the present disclosure will become more readily apparent to those having ordinary skill in the art to which the present disclosure relates from the following detailed description and attached drawings.

BRIEF DESCRIPTION OF THE DRAWING

So that those having ordinary skill in the art will more readily understand how to provide a fuel metering unit in accordance with the present disclosure, preferred embodiments are described in detail below with reference to the figures wherein.

DETAILED DESCRIPTION OF THE PREFERRED EMBODIMENTS

Figure 1A:
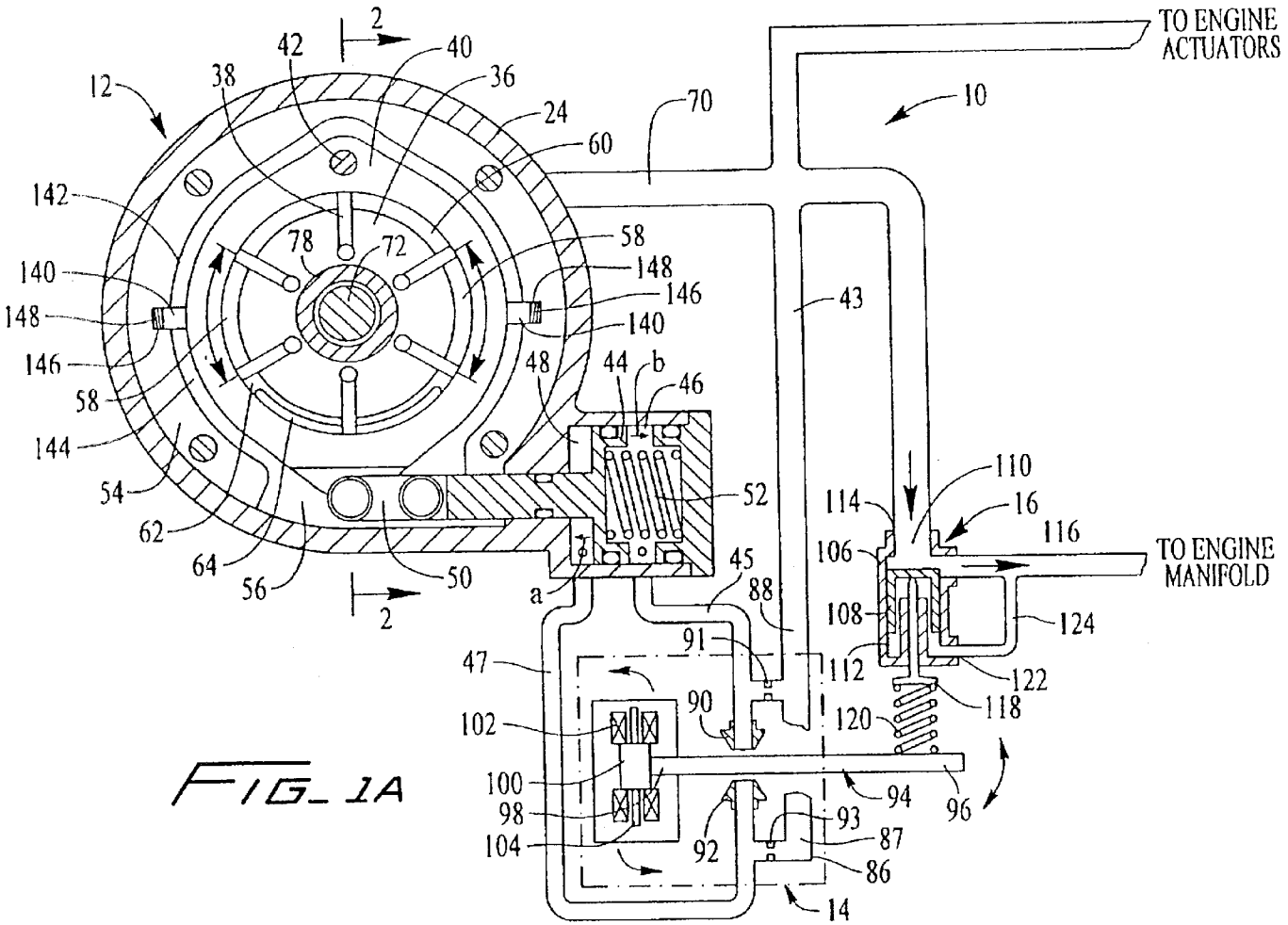
FIG. 1A is a schematic view of a fuel metering unit constructed according to a preferred embodiment of the present disclosure with the vane pump illustrated in cross-section.

The present disclosure overcomes many of the prior art problems associated with fuel metering units. The advantages, and other features disclosed herein, will become more readily apparent to those having ordinary skill in the art from the following detailed description of certain preferred embodiments taken in conjunction with the drawings which set forth representative embodiments and wherein like reference numerals identify similar structural elements.

Figure 1B:
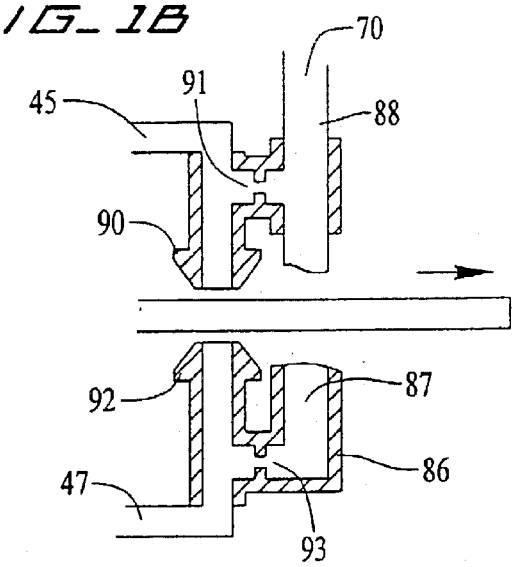
FIG. 1B is an exploded view of a nozzle portion of FIG. 1.
Figure 2:
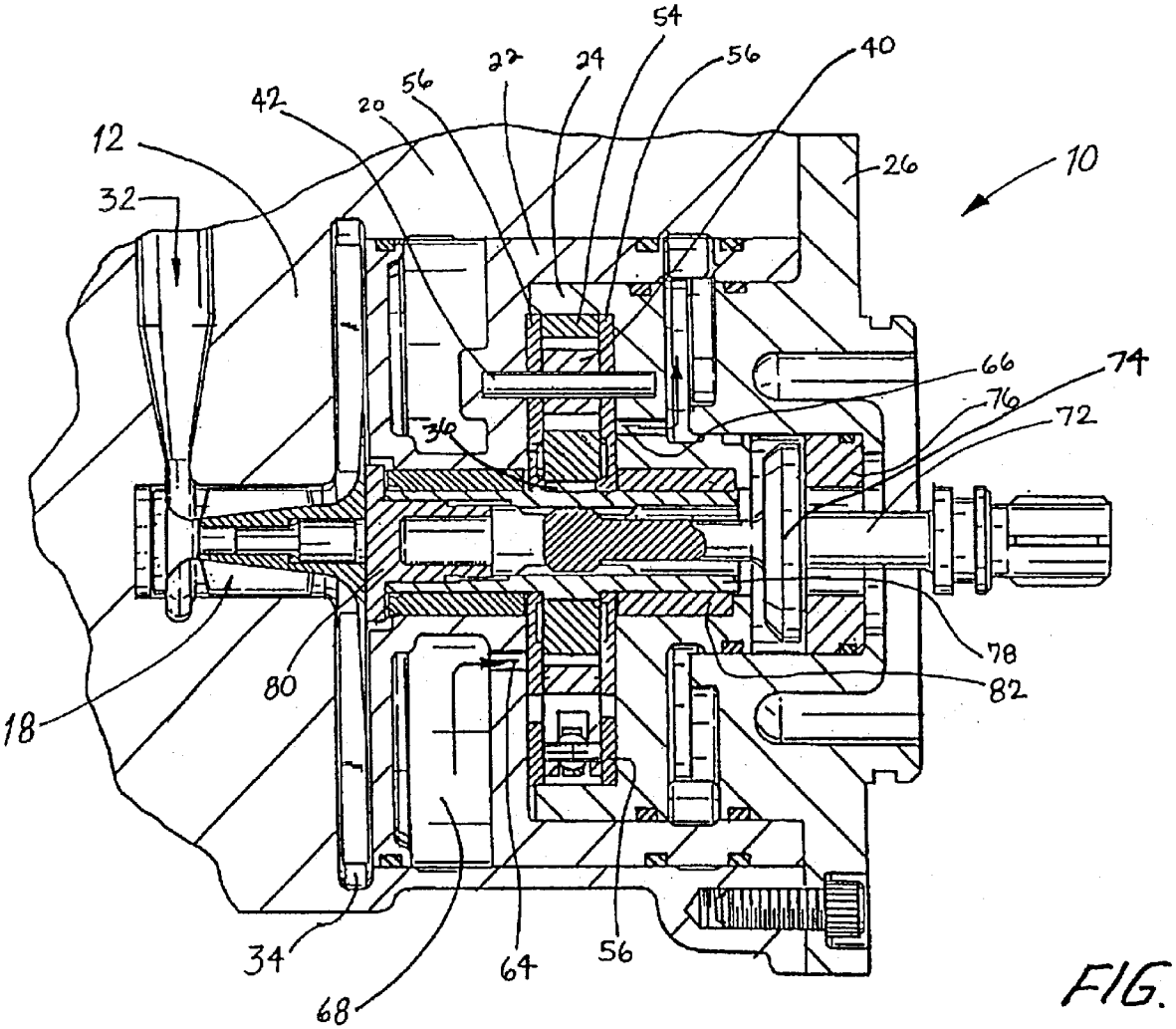
FIG. 2 is a sectional view of the fuel metering unit according to the present disclosure taken along line 2—2 of FIG. 1.

Referring first to FIGS. 1A, 1B and 2, the present disclosure provides a fuel metering unit 10 that is used, for example, to supply pressurized fuel to a manifold of a combustion engine, such as, for example, a gas turbine engine. The fuel metering unit 10 includes a variable displacement vane pump 12 and a torque motor operated servovalve 14 for varying the vane pump output upon receiving a signal from an electronic engine controller (not shown). Similar fuel metering units are shown and described, for example, in U.S. Pat. Nos. 5,545,014 and 5,716,201, the disclosures of which are incorporated herein by reference in their entireties.

The fuel metering unit 10 disclosed herein, however, further includes a flow meter 16 connected downstream of the vane pump 12 and operatively connected to the servovalve 14 for controlling the output of the vane pump 12 in cooperation with a torque motor 100 of the servovalve 14. The actual output of the vane pump 12, as determined by the flow meter 16, will ultimately equal a preferred output of the vane pump 12 as provided to the torque motor 100 by the electronic engine controller (not shown). Accordingly, the fuel metering unit 10 of the subject invention provides accurate, fast and well damped changes in fuel supply, as requested by the engine control. Furthermore fuel metering unit 10 accommodates steady state as well as transient disturbances in parasitic flow to engine actuators by supplying this flow from the discharge of the vane pump 12 while maintaining the fuel supply to the engine manifold, as requested by the electronic engine controller. This precludes potential over fueling or flame out of the combustion engine due to changes in parasitic actuator flow.

The variable displacement vane pump 12 also includes an axial spacer 54 for reducing friction on a pivoting cam ring 40 of the pump, and circumferential seals 140 for reducing leakage between high and low pressure zones 60, 62 of the pump, thereby providing improvements in pump efficiency.

In addition to the vane pump 12, servovalve 14 and flow meter 16, the fuel metering unit 10 includes a boost pump 18 for pressurizing fuel supplied to the vane pump 12, and a housing having four sections 20, 22, 24, 26 that fit together to enclose the boost pump 18 and the vane pump 12. It should be understood that all of the components of the fuel metering unit 10 may be enclosed in a single housing, or may be enclosed in separate housings and connected with conduits as is appropriate and desired.

The boost pump 18 is substantially contained between the first housing section 20 and the second housing section 22. A pump inlet 32, for providing fuel to the boost pump 18, is defined by the first housing section 20. A collector area 34, for receiving charged fuel from the boost pump 18, is defined by the first housing section 20 and the second housing section 22.

The vane pump 12 is substantially contained between the second housing section 22 and the third housing section 24 and includes a rotor 36 having a plurality of vane elements 38 radially supported within vane slots of the rotor 36. The outer tips of the vane elements 38 contact a radially inward surface of a cam ring 40 coaxially surrounding the rotor 36. The cam ring 40 pivots on a pin 42 supported between the second housing section 22 and third housing section 24. A piston 44, best seen in FIG. 1A, adjusts the position of the cam ring 40 and, thus, the vane pump output.

Referring in particular to FIG. 1A, the pump housing defines a piston cylinder receiving the piston 44. The piston cylinder is divided by the piston 44 into first and second piston actuation chambers 46, 48, respectively. As shown, the piston 44 is pivotally connected to the cam ring 40 through a linkage 50. The cam ring 40 is biased in a first direction towards a "MAX STOP" position, wherein the pump displacement is at a maximum, and can be pivoted in an opposite direction, against the biasing force, towards a "MIN STOP" position, wherein the pump displacement is at a minimum. In the specific embodiment shown, the cam ring 40 is biased towards its max stop position by a compression spring 52 positioned in the first pump actuation chamber 46, behind the piston 44.

It should be understood that the present fuel metering unit 10 as disclosed herein is not limited to include the specific vane pump 12 of FIGS. 1A, 1B and 2, as pumps other than the particular arrangement shown can be used. For example, without limitation, a fuel metering unit 10 as described herein can be used with a vane pump as disclosed in U.S. Pat. No. 5,716,201, wherein a cam of the vane pump is pivoted by two opposing pistons. In addition, a vane pump may be provided wherein the cam ring is pivoted by the direct application of fluid pressure to opposite radial sides of the cam ring by a servovalve, without using a piston.

With continuing reference to FIGS. 1A, 1B and 2, vane pump 12 also includes an axial spacer 54 and endplates 56 which help seal a circumferential cavity between the rotor 36 and the cam 40. The axial spacer 54 has a thickness that is slightly greater than a thickness of the cam ring 40, so that the endplates 56 can be tightly clamped against the axial spacer 54 while allowing small gaps to remain between the cam ring 40 and the endplates 56 to reduce or eliminate friction between the cam ring 40 and the endplates 56 during pivotal movement of the cam ring 40. Sealing lands 58 of the endplates 56 divide the circumferential cavity between the cam 40 and the rotor 36 into a primary high pressure zone 60 and a primary low pressure zone 62. The endplates 56 also include an inlet 64 aligned with the low pressure zone 62 and an outlet 66 aligned with the high pressure zone 60. The vane elements 38 transfer fuel from the low pressure zone 62 to the high pressure zone 60 as the rotor 36 turns.

The second housing section 22 defines a vane inlet 68 that communicates through the inlet 64 of the endplate 56 to the low pressure zone 62 of the vane pump 12. The vane inlet 68 is connected to the collector 34 of the boost pump 18 by a diffuser (not shown). A vane outlet 70, which is defined by the third housing section 24, communicates through the outlet 66 of the endplate 56 with the high pressure zone 60 of the vane pump 12.

Power to drive the fuel metering unit 10 is supplied by an engine (not shown) incorporating the fuel metering unit 10, through a primary drive shaft 72. A rim 74 of the shaft 72 is engaged by a shaft seal 76 and the fourth housing section 26 to retain the drive shaft 72 within the housing. Although not shown, the housing sections 20, 22, 24, 26 may be secured together with fasteners, for example. Other components of the fuel metering unit 10 include a rotor 36 coaxially received on the primary drive shaft 72. A secondary drive shaft 80 extends from within the rotor 36 for driving the boost pump 18, and bearings 82 are seated in the housing sections and support the rotor 36 and secondary drive shaft 80.

Still referring to FIGS. 1A and 1B, the servovalve 14 includes a housing 86 having inlet openings 87, 88 in fluid communication with first and second nozzles 90, 92. The opening 88 of the servovalve 14, which in the particular embodiment shown acts as an inlet, is connected to the high pressure outlet 70 of the vane pump 12 by way of conduit 43. The opening 87 of the servovalve 14, also acting as an inlet, is similarly connected to the high pressure outlet 70 of the vane pump 12 by way of conduit 43. First and second orifices 91, 93 limit the flow from the high pressure outlet 70 into the openings 87, 88, respectively. The discharge of the nozzles 90, 92 is referenced to the pressure inlet 62 of the pump 12. The first nozzle 90 of the servovalve 14 is connected to the first actuation chamber 46 of the piston 44 by way of conduit 45. The second nozzle 92 of the servovalve is connected to the second actuation chamber 48 of the piston 44 by way of conduit 47.

An elongated arm 94 extends between the two nozzles for varying the outflow of the nozzles 90, 92. Completely or partially blocking the nozzles 90, 92 shunts the high pressure flow through conduits 45, 47, respectively. Blocking nozzle 90 with the elongated arm 94 decreases fluid flow through the first nozzle 90. As a result, the high pressure flow from high pressure outlet 70 that is directed to the actuation chamber 46 increases. At the same position, the flow is decreased in actuation chamber 48 because the flow is unblocked through the second nozzle 92 by the movement of the elongated arm 94 towards the first nozzle 90. The increased high pressure flow into actuation chamber 46 generates increased pressure that in combination with compression spring 52 overcomes the reduced pressure within actuation chamber 48 and causes the piston 44 to move in the direction indicated by arrow "a". As a result, the cam ring 40 pivots towards the "MAX STOP" position.

Alternatively, decreasing fluid flow through the second nozzle 92 by blocking with the elongated arm 94 increases the high pressure flow directed to the actuation chamber 48 and decreases the high pressure flow directed into actuation chamber 46. The piston 44 overcomes the reduced pressure within the actuation chamber 46 and the compression spring 52 and the piston 44 moves in the direction indicated by arrow "b". As a result, the cam ring 40 pivots towards the "MIN STOP" position.

The elongated arm 94 extends between the nozzles 90, 92 of the servovalve 14 such that, normally, the first and the second nozzles 90, 92 are both in equal fluid communication with the high pressure flow from high pressure outlet 70. However, the elongated arm 94 can be laterally moved to vary the high pressure fluid flow from the nozzles 90, 92. As a result, control of the position of the elongated arm 94 provides control over the position of the cam ring 40. The movement of the elongated arm 94 is accomplished by a torque motor 100.

The torque motor 100 of the servovalve 14 includes spaced-apart coils 102 having openings therein, and an elongated armature 104 positioned with its ends projecting through openings in the coils 102. Other basic components and the operation of a torque motor are known to those skilled in the art. In general, when an electrical current is applied to the coils 102 by an electronic engine controller, the opposed ends of the armature 104 are polarized creating rotational torque on the armature 104 such that opposite ends of the armature 104 move in opposite lateral directions. As the electrical current from the electronic engine controller increases, the rotational torque on the armature 104 increases.

A first end 98 of the elongated arm 94 is connected to the armature 104 such that the arm 94 extends perpendicular to the armature 104. As a current is applied to the coils 102 of the torque motor 100, the rotational torque of the armature 104 causes the elongated arm 94 to pivot about the armature 104 toward one of the nozzles 90, 92 and away from the other nozzle 90, 92. As noted above, moving the elongated arm 94 determines the position of the cam ring 40. As a result, an engine controller can adjust the position of the cam ring 40 and, thus, the output of the vane pump 12 by applying an appropriate electrical current to the torque motor 100.

Referring to FIGS. 1A and 1B, the flow meter 16 includes a housing 106 (which may or may not be unitarily formed with the pump housing as is desired), and a valve member 108 slidingly received in an interior of the housing 106, dividing the housing 106 into first and second chambers 110, 112. The housing 106 includes an inlet 114 and an outlet 116 communicating with the first chamber 110. As shown, the inlet 114 is connected to the high pressure outlet 70 of the vane pump 12, while the outlet 116 of the flow meter 16 is connected to a manifold (not shown) of a combustion engine incorporating the fuel metering unit 10. Although not shown, the fuel metering unit 10 may also include other components, such as a pressure relief valve, a pressure regulating valve and fuel filters operatively positioned before or after the flow meter 16 as may be appropriate and desired.

Fuel flow from the vane pump 12 through the first chamber 110 of the flow meter 16 causes the valve member 108 to move away from the inlet 114 and allow fuel to flow through the flow meter 16 from the inlet 114 to the outlet 116. Increased fuel flow from the vane pump 12 causes the valve member 108 to further open the inlet 114 of the flow meter 16. A plunger 118 is slidingly mounted in the housing 106 for movement with the valve member 108, and a compression spring 120 is operatively positioned between the plunger 118 and the second end 96 of the arm 94 of the servovalve 14. The compression spring 120 couples the elongated arm 94 to the plunger 118 and provides a variable biasing force laterally against the arm 94.

During operation, as valve member 108 of flow meter 16 opens in response to fuel flow from vane pump 12, the compression spring 120 compresses to apply an increased biasing force laterally against the second end 96 of the elongated arm 94. The compression spring 120 is sized so that it tends to re-center the arm 94 between the nozzles 90, 92 of the servovalve 14. Positioning of the cam ring 40 of vane pump 12, therefore, occurs at a point in which the force of the compression spring 120 of the flow meter 16 equals the force of the torque motor 100 induced by the electronic engine controller. The cam ring 40 stops at this position and the arm 94 is essentially centered until the electrical signal from the engine controller changes to a different level. Consequently, the flow meter 16 serves to control the output of the vane pump 12 in cooperation with the torque motor 100 by providing feedback to the arm 94 of the servovalve 14, so that an actual output of the vane pump 12, as determined by the flow meter 16, will ultimately equal a preferred output of the vane pump 12, as requested from the torque motor 100 by the electronic engine controller. A fuel metering unit 10 constructed in accordance with the present disclosure, therefore, quickly and accurately delivers actual fuel flow to the engine manifold in accordance with the preferred output from the electronic engine controller.

As a result of the above, the response to the electronic engine controller is damped to prevent minor transient disturbances from affecting performance. To further provide smooth operation, the housing 106 of the flow meter 16 includes a port 122 providing fluid communication with the second chamber 112 of the flow meter 16. A passage 124 connects the port 122 to the outlet 116 of the flow meter 16 to provide downstream reference to the back of the valve member 108 of the flow meter 16. Preferably, passage 124 contains an orifice (not shown) which restricts the amount of fluid which may be displace by the valve member. Therefore, the movement of the valve member 108 is dampened and slides in a smooth manner eventhough the output of the vane pump 12 may have transient irregularities.

Still referring to FIGS. 1A, 1B and 2, in addition to the axial spacer 54, which reduces or eliminates friction between the cam ring 40 and the endplates 56 during pivotal movement of the cam ring 40, the vane pump 12 is provided with circumferential seals 140 radially extending between a radially inward surface of the axial spacer 54 and a radially outward surface of the cam ring 40, in alignment with the sealing lands 58 of the endplates 56. The circumferential seals 140 divide the cavity formed between the axial spacer 54 and the cam ring 40 into a secondary high pressure zone 142 and secondary low pressure zone 144, and prevent circumferential fuel flow therebetween.

During operation of the vane pump 12, friction between the cam ring 40 and the endplates 56, during pivotal movement of the cam ring 40 can be reduced or eliminated by incorporating the axial spacer 54. However, the axial spacer 54 provides opportunity to some fuel to seep from the primary high pressure zone 60 to the secondary high pressure zone 142 between the cam ring 40 and the endplates 56. The circumferential seals 140 prevent fuel in the secondary high pressure zone 142 from flowing circumferentially into the secondary low pressure zone 144, where the high pressure fuel could then seep into the primary low pressure zone 62.

Preferably, the circumferential seals 140 are seated in slots 146 in the radially inward surface of the axial spacer 54. The slots 146 are positioned between the inlet 64 and the outlet 70. In addition, the seals 140 are preferably biased radially towards the cam ring 40 by springs 148 positioned in the slots 146, so that tips of the seals 140 are always in contact with the radially outward surface of the cam ring 40, regardless of the pivotal movement of the cam ring 40. Thus, fuel leakage between the primary high pressure and low pressure zones 60, 62 due to the axial spacer 54 is reduced by the circumferential seals 140.

Figure 3:
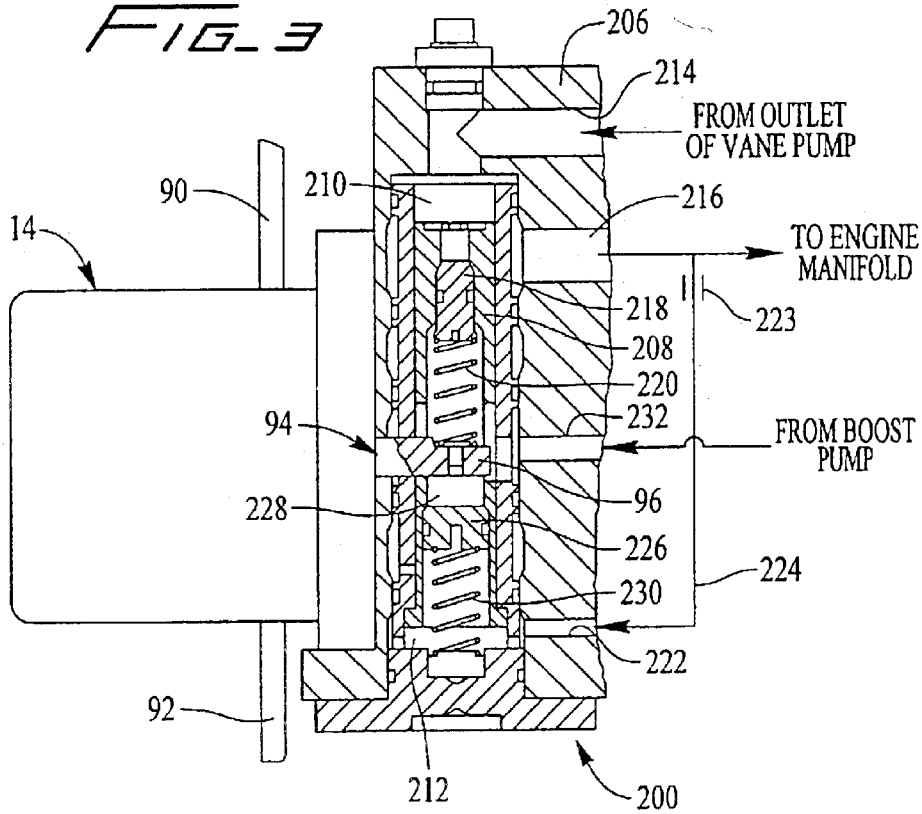
FIG. 3 is a sectional view of a preferred embodiment of a flow meter for use with a fuel metering unit according to the present disclosure.

Referring to FIG. 3, another embodiment of a flow meter for use with the fuel metering unit 10 of the present disclosure is shown, and designated generally by reference numeral 200. Elements of the flow meter 200 of FIG. 3 that are similar to elements of the flow meter 16 of FIG. 1A have the same reference numeral preceded with a "2".

As shown in FIG. 3, the flow meter 200 is arranged with respect to the servovalve 14 such that the second end 96 of the arm 94 extends into the housing 206 of the flow meter 200. The flow meter 200 further includes a plug 226 secured to the valve member 208, wherein the valve member 208 and plug 226 are operatively positioned within the housing 206. The housing 206 defines a first chamber 210 above the plunger 218, a second chamber 212 below the plunger and a third chamber 228 between the plug 226 and the plunger 218. A primary compression spring 220 is operatively positioned between the plunger 218 and the second end 96 of the arm 94 of the servovalve 14 to provide a spring force laterally against the arm 94. A secondary compression spring 230 is operatively positioned within the second chamber 212 to provide a minimum gain on the valve member 208.

The housing 206 includes a top inlet 214 and an outlet 216 communicating with the first chamber 210. It is envisioned that the top inlet 214 is connected to the high pressure outlet of the vane pump (not shown), while the outlet 216 of the flow meter 200 is connected to a manifold (not shown) of a combustion engine. The housing 206 of the flow meter 200 also includes a middle inlet 232 providing fluid communication to the third chamber 228. The middle inlet 232 is connected to the boost pump 18 to provide a reference pressure in the third chamber 228. The housing 206 of the flow meter 200 also includes a bottom inlet 222 providing fluid communication with the second chamber 212 of the flow meter 200. A passage 224 connects the bottom inlet 222 to the outlet 216 of the flow meter 200 to provide feedback pressure and dampen movement of the valve member 208 of the flow meter 200. Preferably, an orifice 223 restricts the flow within passage 224 for dampening the movement of the valve member 208.

FIGS. 4–8 illustrate additional embodiments of a fuel flow sensor for use with the fuel metering unit 10 of the present disclosure. It is envisioned that each of these flow meters may be used advantageously in a multitude of applications as would be appreciated by those skilled in the art upon review of the subject disclosure. Additionally, FIGS. 5-8 are embodiments which incorporate electromechanical feedback mechanisms in order to provide accurate closed loop control based upon engine speed, temperature, acceleration, deceleration and the like as controlling parameters.

Figure 4:
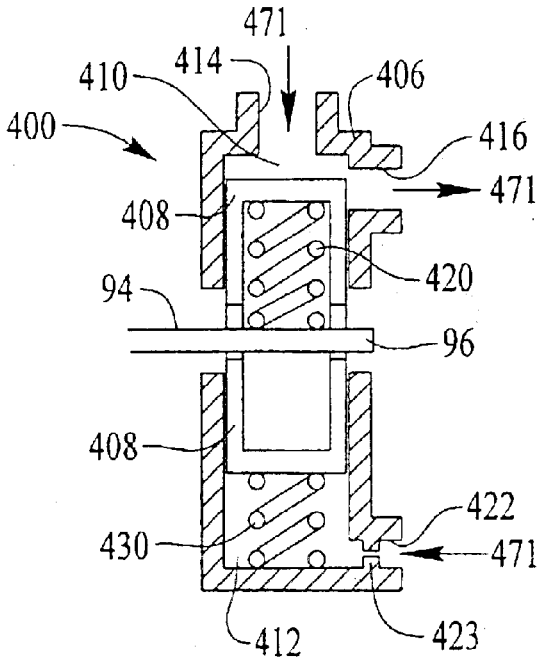
FIG. 4 is a schematic view of a flow meter for use with a fuel metering unit according to the present disclosure with the elongated arm coupled intermediate the top and bottom of the valve member.

Referring to FIG. 4, there is shown a flow meter 400 for use with a fuel metering unit 10 of the present disclosure. Elements of the fuel flow meter 400 that are similar to elements of the flow meter 16 of FIG. 1A have the same reference numeral preceded with a "4". The direction of fuel flow is indicated by arrows 471.

As shown in FIG. 4, the flow meter 400 is arranged with respect to the servovalve 14 such that the second end 96 of the arm 94 extends into the housing 406 of the flow meter 400. The flow meter 400 further includes a housing 406 defining a first chamber 410 above the valve member 408 and a second chamber 412 below the valve member 408. A primary compression spring 420 is operatively positioned between the valve member 408 and the second end 96 of the arm 94 of the servovalve 14 to provide a biasing force laterally against the arm 94. Preferably, a secondary compression spring 430 is operatively positioned within the second chamber 412 to provide a minimum gain on the valve member 408.

The housing 406 includes a top inlet 414 and an outlet 416 communicating with the first chamber 410. It is envisioned that the top inlet 414 is connected to the high pressure outlet of the vane pump (not shown), while the outlet 416 of the flow meter 400 is connected to a manifold (not shown) of a combustion engine. The housing 406 of the flow meter 400 also includes a bottom inlet 422 providing fluid communication with the second chamber 412 of the flow meter 400. A passage (not shown) connects the bottom inlet 422 to the outlet 416 of the flow meter 400 to provide feedback pressure and dampen movement of the valve member 408 of the flow meter 400. Preferably, the bottom inlet 422 contains an orifice 423 to provide damping.

Figure 5:
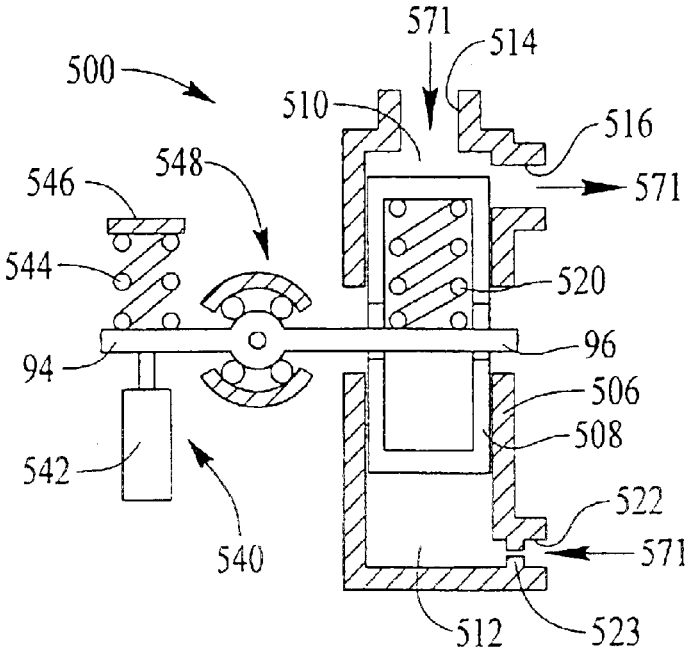
FIG. 5 is a schematic view of another flow meter for use with a fuel metering unit according to the present disclosure with an LVDT sensing the position of the elongated arm.

Referring to FIG. 5, there is illustrated a flow meter 500 for use with a fuel metering unit. Elements of the flow meter 500 that are similar to elements of the flow meter 16 of FIG. 1A have the same reference numeral preceded with a "5". The direction of fuel flow is indicated by arrows 571.

The flow meter 500 is adapted for a device 540 to measure the position of the arm 94. The position of the arm 94 is a function of the position of the valve member 508. The position of the valve member 508 corresponds to the amount of fuel which may pass through top inlet 514, i.e. the fuel flow. Thus, the position of the arm 94 is indicative of the fuel flow.

In a preferred embodiment, the device 540 includes a Linear Variable Differential Transformer 542 (hereinafter "LVDT"), an arm spring 544, a mount 546 and a seal 548. Preferably, the LVDT 542 is coupled to the arm 94 in order to generate a position measurement of the arm 94. The position measurement of the LVDT 542 is an electrical signal which can be used as feedback for the electronic engine controller. The arm 94 pivots about the seal 548. In one embodiment, a pin (not shown) extends through the seal 548 for supporting the arm 94 and providing a pivot point. The arm spring 544 extends between the arm 94 and mount 546 to provide a force in opposition to the LVDT 542 and spring 520. Preferably, the device 540 is located in ambient air and the seal 548 is a frictionless fuel to air seal to accommodate such an arrangement. Preferably, the bottom inlet 522 contains an orifice 523 to provide damping.

Figure 6:
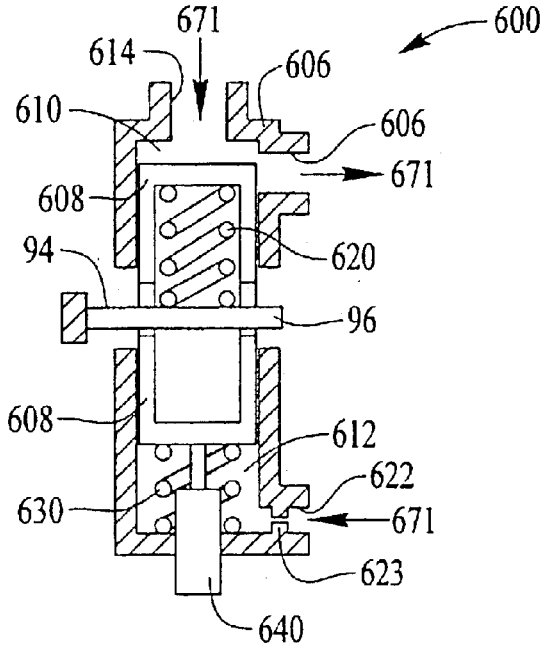
FIG. 6 is a schematic view of still another flow meter for use with a fuel metering unit according to the present disclosure with an LVDT sensing the position of the valve member.

Referring to FIG. 6, there is shown a flow meter 600 for use with a fuel metering unit. Elements of the fuel flow meter 600 that are similar to elements of the flow meter 16 of FIG. 1A have the same reference numeral preceded with a "6". The direction of fuel flow is indicated by arrows 671.

The flow meter 600 is adapted for a device 640 to measure the position of the valve member 608. The position of the valve member 608 is a function of the amount of fuel which may pass through top inlet 614, i.e. the fuel flow. Thus, the position of the valve member 608 can be converted into a fuel flow measurement. Arm 94 extends into valve member 608 to provide a mount for spring 620 for providing a biasing force against the back of valve member 608. In a preferred embodiment, the device 608 is a LVDT coupled to the housing 606 and valve member 608 in order generate a position measurement as is known to those skilled in the art and therefore not further described herein. Spring 630 is mounted between the bottom of valve member 608 and housing 606 in order to provide additional biasing force. Preferably, the bottom inlet 622 contains an orifice 623 to provide damping.

Figure 7:
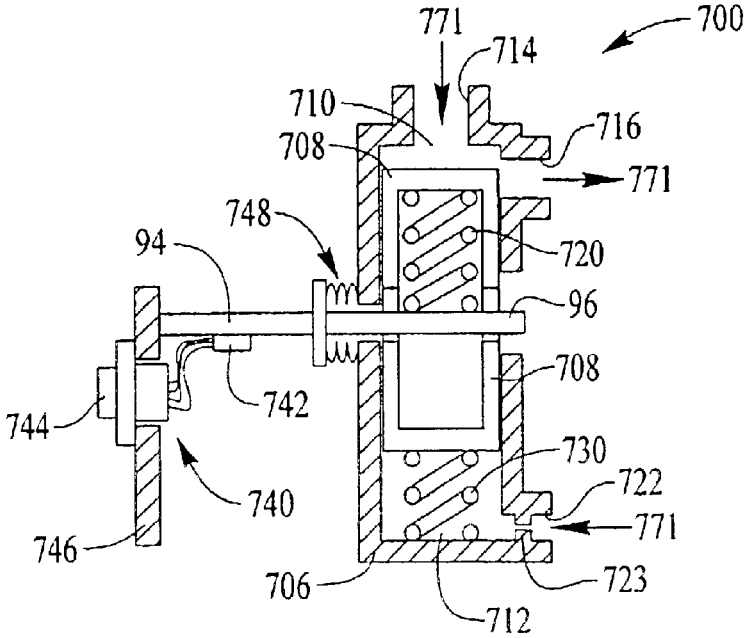
FIG. 7 is a schematic sectional view of yet another flow meter for use with a fuel metering unit according to the present disclosure with a strain gauge sensing the force on the elongated arm.

Referring to FIG. 7, another flow meter 700 for use with a fuel metering unit. Elements of the flow meter 700 that are similar to elements of the flow meter 16 of FIG. 1A have the same reference numeral preceded with a "7". The direction of fuel flow is indicated by arrows 771.

The flow meter 700 is adapted for a device 740 to measure the force applied to the arm 94. The force applied to the arm 94 determines the position of the arm. As noted above, the position of the arm 94 is indicative of the fuel flow. Thus, the force applied to the arm 94 provides an indication of the fuel flow as well.

In a preferred embodiment, the device 740 includes a strain gauge 742 having a connector 744, a mount 746 and a seal 748. The strain gauge 742 is coupled to the arm 94 in order measure the force applied thereto. The electrical signal generated by the strain gauge passes through the connector 744 to provide feedback for the electronic engine controller. The mount 746 fixes the connector 744 in place. Preferably, the device 740 is located in ambient air and the seal 748 is a frictionless fuel to air seal to accommodate such an arrangement. Preferably, the bottom inlet 722 contains an orifice 723 to provide damping.

Figure 8:
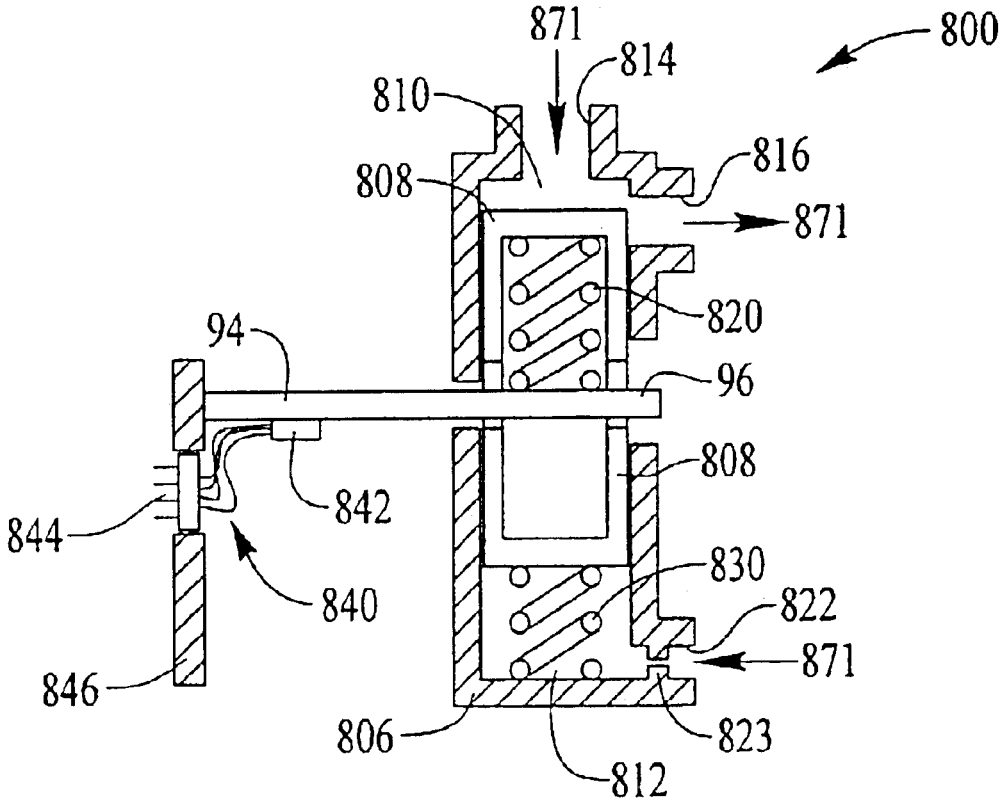
FIG. 8 is a schematic sectional view of yet still another flow meter for use with a fuel metering unit according to the present disclosure with a strain gauge sensing the force on the elongated arm.

Referring to FIG. 8, there is shown a flow meter 800 for use with the fuel metering unit. Elements of the flow meter 800 that are similar to elements of the flow meter 16 of FIG. 1A have the same reference numeral preceded with a "8". The direction of fuel flow is indicated by arrows 871.

The flow meter 800 is similar to the flow meter 700 of FIG. 7, therefore, only the differences will be discussed in further detail. In a preferred embodiment, the device 840 of flow meter 800 includes a strain gauge 842 having a glass header 844 and a mount 846. The electrical signal generated by the strain gauge passes through the glass header 844 to provide feedback for the electronic engine controller. The mount 846 fixes the glass header 844 in place. Preferably, the bottom inlet 822 contains an orifice 823 to provide damping.

It should be understood that the foregoing detailed description and preferred embodiments are only illustrative of a fuel metering unit and variable displacement vane pumps according to the present disclosure. Various alternatives and modifications to the presently disclosed fuel metering unit and variable displacement vane pumps can be devised by those skilled in the art without departing from the spirit and scope of the present disclosure. Accordingly, the present disclosure is intended to embrace all such alternatives and modifications that fall within the spirit and scope of the fuel metering unit and the variable displacement vane pumps as recited in the appended claims.

What is claimed is:

1. A flow meter for indicating an output of a pump comprising:

a) a housing defining an internal chamber, a primary inlet for receiving the output of the pump, an outlet in fluid communication with the primary inlet through a passageway formed in the housing, and a secondary inlet for receiving a scavenged portion of the output passing through the outlet; and b) a valve member slidingly received within the internal chamber for varying flow through the passageway such that the output of the pump and the scavenged portion each exert a force on the valve member, wherein a first force exerted by the scavenged portion is a downstream reference pressure opposing a second force exerted by the output of the pump.

2. A flow meter as recited in claim 1, further comprising a spring for coupling the valve member to an elongated arm.

3. A flow meter as recited in claim 1, further comprising a spring between the valve member and the housing for applying a biasing force to the valve member.

4. A flow meter for dampening responses to minor transients in fuel flow to an engine, the flow meter comprising:

(a) a housing forming an interior chamber, the interior chamber having i) a first chamber;

ii) a second chamber;

iii) an inlet in fluid communication with the first chamber for connection to a high pressure outlet of the vane pump;

iv) an outlet in fluid communication with the first chamber for connection to the engine, v) a port in fluid communication with the second chamber, and vi) a passage connecting the port to the outlet of the flow meter to provide a downstream reference to the second chamber of the flow meter; and (b) a valve member slidingly received in the interior chamber of the housing for varying fuel flow from the inlet to the outlet, and dividing the housing into the first and second chambers, wherein increased fuel flow from the pump through the first chamber causes the valve member to move away from the inlet.

5. A flow meter as recited in claim 4, further comprising an orifice formed in the passage for restricting an amount of fluid which may be displace by the valve member.

6. A flow meter as recited in claim 4, further comprising a plunger slidingly mounted in the housing for movement with the valve member.

7. A flow meter as recited in claim 6, further comprising a compression spring operatively positioned between the plunger and the housing to provide a biasing force.

8. A flow meter as recited in claim 4, wherein the housing is unitarily formed with a second housing of the pump.

* * * * *